United States Patent [19]

Flach et al.

[11] 4,369,071

[45] Jan. 18, 1983

[54] PROCESS AND ARRANGEMENT FOR INTRODUCING AN AUTOMATIC CLEANING MECHANISM INTO A GUN BARREL

[75] Inventors: Jürgen Flach, Duesseldorf; Rigobert Opitz, Hamburg; Karl W. Bethmann, Moers, all of Fed. Rep. of Germany

[73] Assignee: Rheinmetall GmbH, Duesseldorf, Fed. Rep. of Germany

[21] Appl. No.: 193,645

[22] Filed: Oct. 3, 1980

[30] Foreign Application Priority Data

Oct. 3, 1979 [DE] Fed. Rep. of Germany ..... 2940082

[51] Int. Cl.[3] ..... F41F 17/14

[52] U.S. Cl. ..... 134/8; 15/104.09; 15/104.2

[58] Field of Search ..... 134/8, 22.11; 15/104.2, 15/104.09

[56] References Cited

U.S. PATENT DOCUMENTS

| | | | |
|---|---|---|---|
| 937,729 | 10/1909 | Upham | 15/104.2 |
| 2,789,296 | 4/1957 | Cheadle | 15/104.2 |
| 4,290,163 | 9/1981 | Opitz et al. | 15/104.09 |

*Primary Examiner*—Richard V. Fisher

[57] ABSTRACT

A process and arrangement for introducing an automatic cleaning device into the open end of a gun barrel so that the cleaning device may reciprocably move through the gun barrel and clean it. The cleaning device includes a drive motor, drive rollers, a pair of oppositely rotating brush members and sensing means. The arrangement for introducing the cleaning device into the gun barrel includes a lower trough-like member adapted to be joined to the muzzle of the gun barrel and an upper complementary member which jointly form a composite pipe member having essentially the same caliber than the gun barrel. A centering and tensioning mechanism is mounted on the muzzle of the gun barrel and serves to connect the composite pipe member to the gun barrel in axial alignment therewith. The cleaning device is positioned on the trough-like member and thereafter the complementary member is mounted on the trough-like member and connected thereto. The cleaning device is then introduced into the gun barrel in a last process step.

The process and arrangement of the invention for introducing an automatic cleaning device can also be used to clean cylindrical surfaces other than gun barrels such as, for example, pipe lines which can be disassembled.

7 Claims, 5 Drawing Figures

PROCESS AND ARRANGEMENT FOR INTRODUCING AN AUTOMATIC CLEANING MECHANISM INTO A GUN BARREL

BACKGROUND OF THE INVENTION

The invention pertains to a process and arrangement for automatically cleaning the interior surfaces of a gun barrel.

An arrangement for removing residues and sediments from the interior surfaces of gun barrels (hereinafter referred to as cleaning device) has been described in the copending and co-assigned application Ser. No. 074,040, filed Sept. 10, 1979 (now U.S. Pat. No. 4,290,163). In the cleaning device described in the copending application the forwardly and rearwardly arranged brushes rotate in opposite directions. In this way the frictional torques which occur inside the gun barrel compensate each other and there is not formed an overall resulting torque on the cleaning device, which could impart an undesirable rotation about its longitudinal axis as it advances along the bore axis of the gun barrel. The afore-described automatic cleaning device, can for example, in a gun barrel of 120 mm caliber, replace a brush arranged on a six meter long rod which requires to be serviced by no less than 7 persons.

In the afore-described cleaning device of copending application Ser. No. 074,040 (now U.S. Pat. No. 4,290,163) it has been proven disadvantageous that the complete introduction of the cleaning device into the gun barrel to be cleaned can only be carried out with the application of considerable pressure in the longitudinal direction, whereby the cleaning device itself can be damaged. A complete introduction of the cleaning device is, however, necessary in order to avoid an undesirable rotation of the cleaning device about its longitudinal axis.

SUMMARY OF THE INVENTION

It is an object of this invention to provide a process and arrangement for introducing the afore-described cleaning device in a relatively effortless manner into the gun barrel, whereby the application of pressure applied from the outside in the longitudinal axial direction is dispensed with while at the same time the undesirable rotation of the cleaning device about its longitudinal axis is avoided.

German published patent application No. 28 05 328 discloses a process and arrangement for introducing a folded parachute into a container, whereby the parachute is transferred from a transporting package having substantially the same diameter than the container into the container. In this known arrangement it has been proven that an auxiliary packaging is disadvantageous. The auxiliary packaging covers the folded parachute prior to its introduction into the transport packaging. Also a drawback is the fact that the auxiliary packaging containing the parachute is introduced into the container with the application of pressure.

BRIEF DESCRIPTION OF THE DRAWINGS

These and other objects of the present invention are realized and illustrated in the several preferred embodiments shown in the accompanying drawings.

DETAILED DESCRIPTION OF PREFERRED EMBODIMENTS

Figure 1:
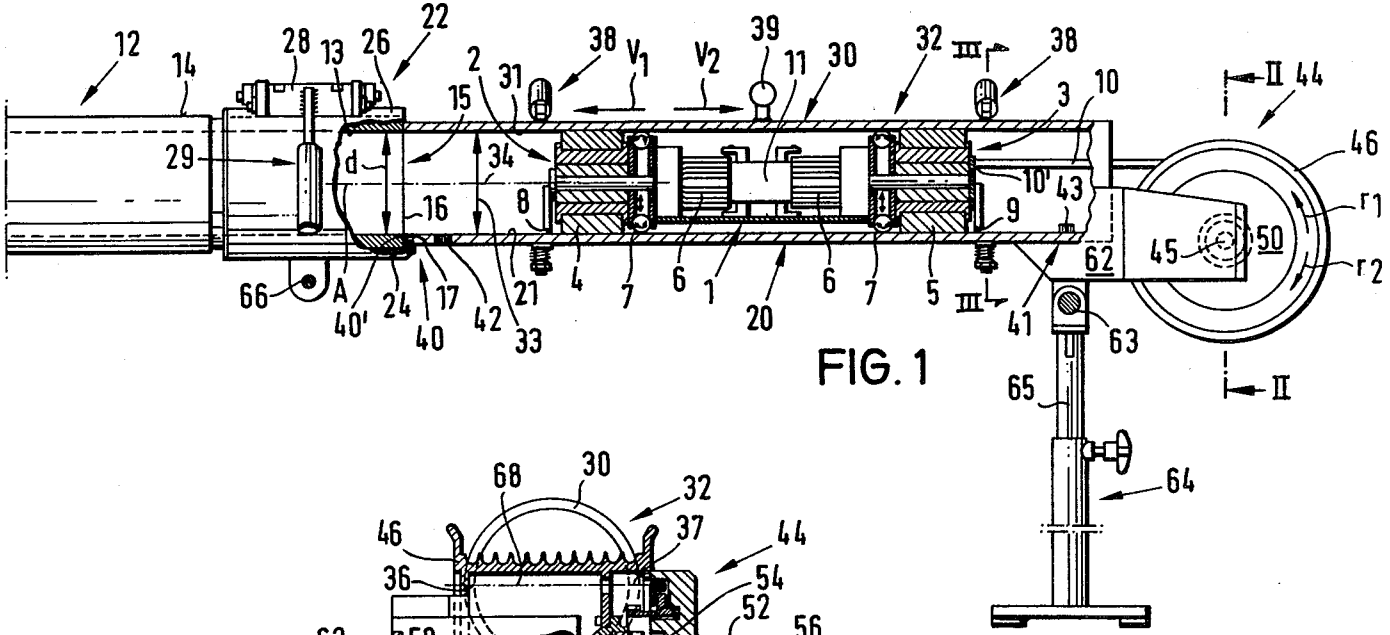
FIG. 1 illustrates schematically in side elevation a gun barrel, at the muzzle end of which there is mounted an arrangement in accordance with this invention for introducing a cleaning device, several portions of the gun barrel and cleaning device being shown in section for sake of clarity.
Figure 2:
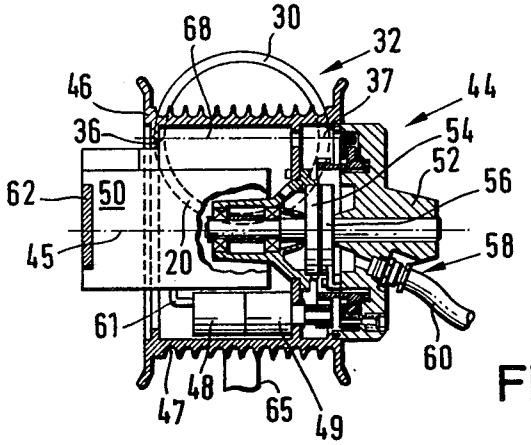
FIG. 2 is a cross-sectional view along line II—II of FIG. 1, FIGS. 3 and 3A are cross-sectional views along line III—III of FIG. 1 illustrating respectively two different embodiments of the composite pipe forming part of the invention.
Figure 3:
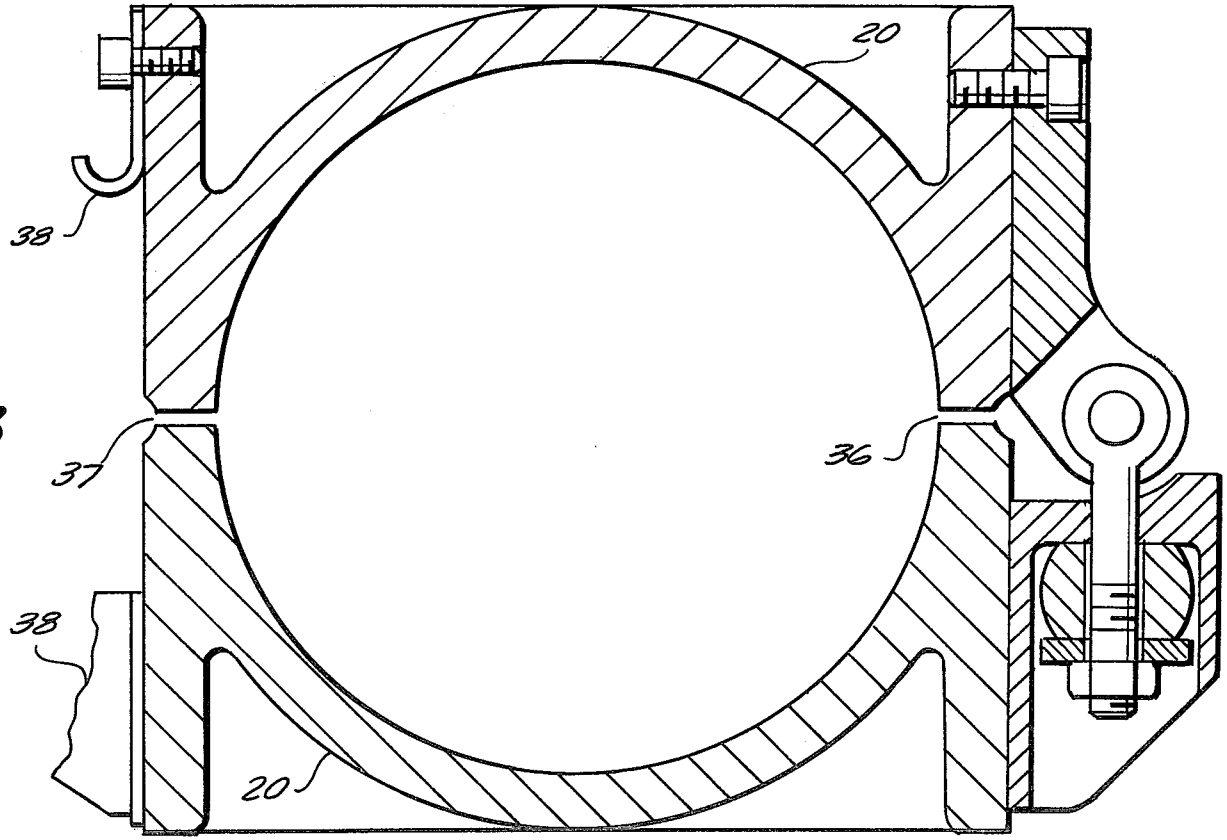
Figure 3A:
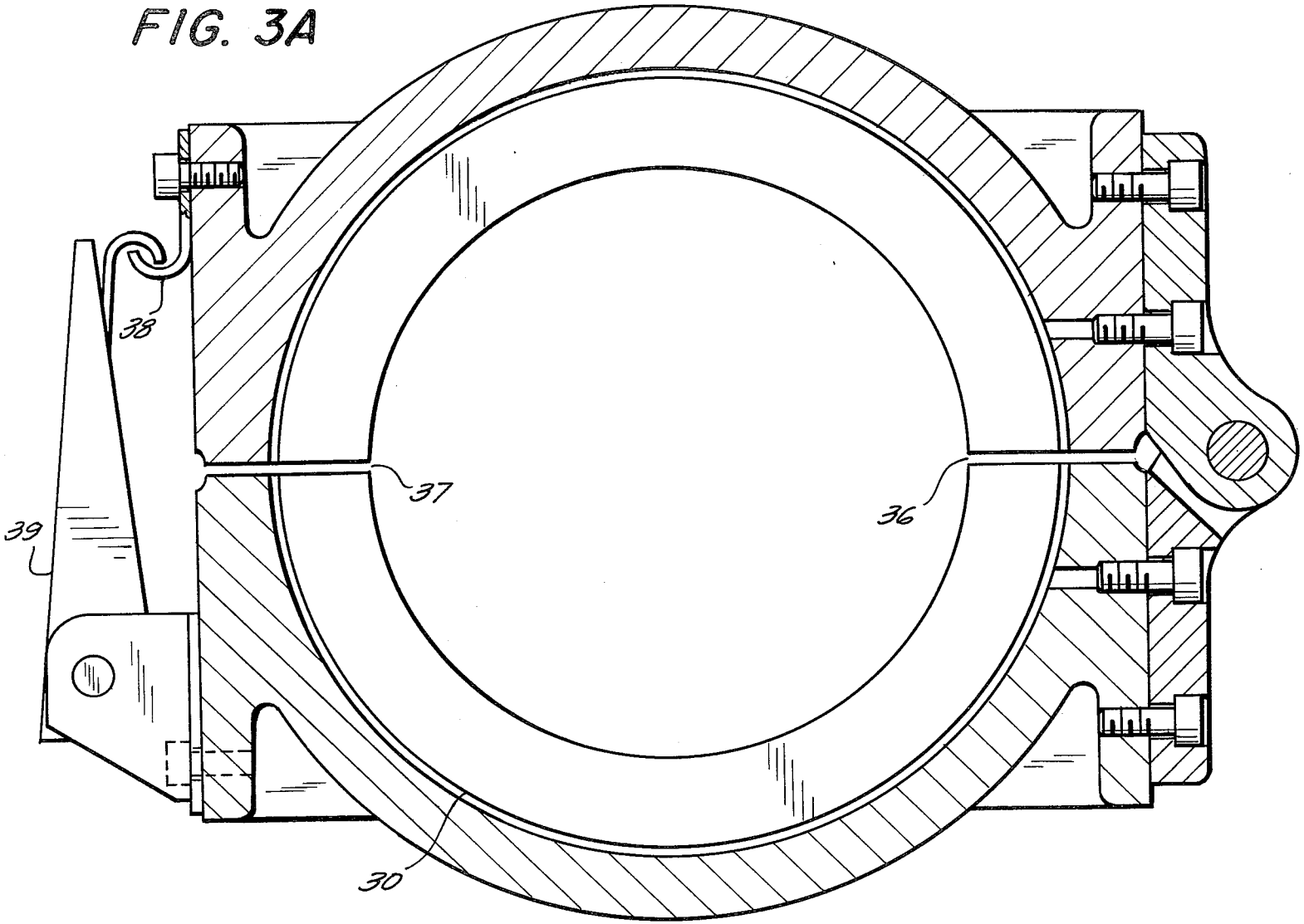
Figure 4:
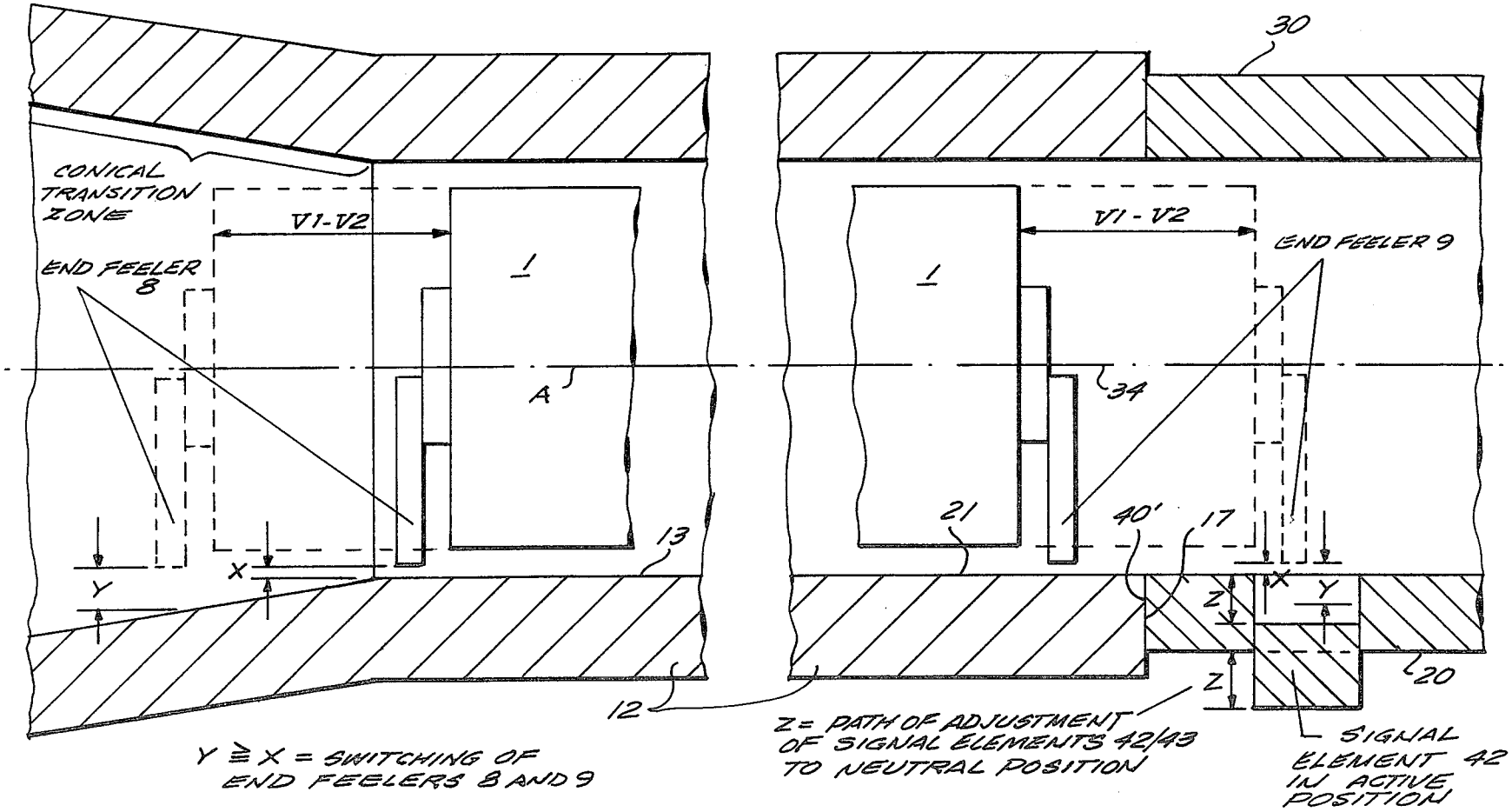
FIG. 4 is a schematic longitudinal sectional view of the arrangement of this invention.

The arrangement of this invention comprises a carriage 20 which is connected at one of its ends 40 with a lower cup portion 24 of a centering and tensioning arrangement 22 so as to form a unitary construction therewith. An upper portion 26, also cup-shaped, is pivotally connected along one of its longitudinal side with the lower cup portion 24 to form therewith a partition gap; both of the other confronting longitudinal sides of the cup portions 24, 26 are connected to each other, by means of known connecting and tensioning mechanisms 28, 29, forming also therebetween a separating gap, said longitudinal sides being detachably connected with each other. The remainder of the carriage 20 is formed as a trough having a semi-circular profile. Along one longitudinal side of the carriage 20 there is articulated a complementary element 30 for forming a separating gap 37, whereas both of the other longitudinal sides are connected to each other by means of connecting and tensioning means 38, while forming a separating gap 36 therealong. The complementary element 30 is, identical to the carriage 20, formed as a trough having a semi-circular profile, so that the carriage 20 and element 30 complete the formation of a composite pipe 32, the inner diameter of which corresponds to the caliber d of gun barrel 12. In accordance with FIG. 1 the arrangement of the invention is detachably connected to the gun barrel 12 in the region of the muzzle 15 of the gun barrel 12 by means of the centering and tensioning mechanism 22 in such a way that the longitudinal axis 34 of the composite pipe 32 coincides with the bore axis A of the gun barrel 12. The lower cup 24 and upper cup 26 abut against each other with their inner surfaces on the outer surfaces 14 of the gun barrel 12. At its other end 41 the carriage 20 is provided with a bracket 62 on which a guiding pulley arrangement 44 is mounted. The guiding pulley arrangement 44 includes guiding means 50, 52 and an energy supply conduit 58 connected to a pair of clutch rings 54, 56, a cable drum 46, a motor 48 with gear drive train 49. The control means 50, 52 are programmable by means of conventional electronic circuitry and control the operation of the motor 48 via the conduit 61. The gear drive train 49 serves to drive the cable drum 46 rotatably mounted on the bracket 62 about the rotatable axis 45.

According to FIG. 1, there is mounted in the composite pipe 32 a cleaning device 1 in accordance with U.S. patent application Ser. No. 074,040, filed Sept. 10, 1979 (now U.S. Pat. No. 4,290,163). In an end region 2 (3) the cleaning device has rotating brushes 4, 5 corresponding to the caliber d of the gun barrel 12; both of the brushes 4, 5 are driven by means of a motor 6 as well as the advancing rollers 7 which also serve to center the cleaning device 1 in the gun barrel 12, and the composite pipe 32. In the end region 2 (3) there is mounted a feeler 8 (9). A longitudinal conduit 10 extending into the end region 3 is paid out in a non-illustrated manner from the peripheral winding surface 47 of the winding drum 46 and is incorporated via the control means 50, 52 into the energy supply of the entire arrangement. The bracket 62 supports at its underside an undercarriage 64 having a telescopically arranged pole 65 mounted therein which is pivotally connected to the bracket 62 by means of a pivot connection 63. At the end region 40 (41) of the carriage 20 there are mounted signaling elements 42 (43) which have only been schematically illustrated, and which coact with the corresponding end feelers 8 and 9 as will be further described hereinbelow.

Manner of Operation

The to be cleaned gun barrel 12 is positioned as illustrated in FIG. 1 prior to cleaning. In a first process step the carriage 20 is detachably secured to the muzzle 15 of the gun barrel 12, whereby the lower cup 24 and the upper cup 26 are tightly mounted on the outer peripheral surface 14 of the gun barrel 12 in the region of a non-illustrated separating gap by means of the mechanisms 28, 29. The carriage 20 now represents an extension of the gun barrel along the bore axis A thereof and bears with a circular ring surface 40' tightly against a circular ring surface 17 in the muzzle plane 16. The support elements 64, 65 can be mounted on a non-illustrated floor surface and secured thereon. The cable conduit 10, which serves to supply the arrangement with energy and control the cleaning device 1 is wound on the cable drum 46. In a further process step of the invention, the cleaning device 1 is mounted on the upwardly directed inner surface 21 of the carriage 20. An end 10' of the cable 10 is connected to the cleaning device 1. In a further process step the semi-cylindrical element 30 is now mounted on top of the carriage 20 and forms with the latter the composite pipe 32, which is of the same caliber than the gun barrel 12 and whose longitudinal axis 34 coincides with the bore axis A. The separating gaps 36, 37, which extend along the exterior surface of the so-formed composite pipe 32 along a horizontally bisecting plane, separate the semi-cylindrical parts 20 and 30. The semi-cylindrical parts 20 and 30 are detachably connected to each other in a known manner, for example, by Camloc fasteners Series V18L distributed by Rexnard, Inc. of Paramus, N.J. (The semi-cylindrical element 30 can also be pivotally connected along the separating gap 37 to the semi-cylindrical carriage 20, and by means of manipulating a handle 39, affixed to the semi-cylindrical member 30, the latter can be tilted over the semi-cylindrical carriage member 20 thereby covering the cleaning device 1 and can be connected to the semi-cylindrical carriage member 20 by means of connecting and tensioning means 38, schematically illustrated in FIG. 1, to form the composite pipe 32). The main energy supply conduit 60 is connected via the coupling 58 to the driving mechanism 44 and is also connected in a conventional manner to a non-illustrated energy source, for example, the electrical supply circuit of a tank. In a last process step, the advancing rollers 7 are driven and the brushes 4 and 5 are rotated about a common longitudinal axis 11 in mutually opposite directions, so that when the cleaning device moves in the direction of an arrow $v_1$ there does not result a turning moment due to the frictional engagement of the brushes 4 and 5 with the inner cylindrical wall, which could force the cleaning device to turn about its longitudinal axis 11. The afore-mentioned signal element 42 is in a neutral position, in which the inner surface 21 of the carriage 20 causes the feeler 8 to be in a closed position. A separation gap between the annular surfaces 17 and 40' is not "recognizable" for the end feeler 8. The cleaning device 1 moves with its brush 4 into the gun barrel 12, while the oppositely rotating brush 5 is still located in the cylindrical composite pipe 32. The motor 48 drives via the gear drive 49 the cable drum 46 in the direction of the arrow $r_1$ and its linear pay out speed corresponds to the advancing speed of the cleaning device 1. In this manner the cleaning device 1 penetrates more and more into the gun barrel 12, whereby finally the end feeler 9 passes over the region of the neutral—positioned element 42 as well as over the separating gap 17, 40' without reacting. As soon as this has occurred, the signal element 42 is moved a distance z into a switching position to be described hereinbelow. The cleaning device 1 moves further into the direction of the arrow $v_1$ and carries out a cleaning operation which will not be described in detail, but which is carried out in accordance with the operating program programmed into the drive of the cleaning device 1 by means of the control means 50, 52. When, during movement in the direction of the arrow $v_1$ the end feeler 8 reaches a transition cone or edge disposed between the portion of the gun barrel having the inner cylindrical surface 13 of the gun barrel 12 and a loading chamber where an edge or throat is "recognized," a reversing signal is formed and transmitted, which when received by the control means 50, 52, produces a command signal, which causes the advancing roller 7 to move the cleaning device 1 in the direction of the arrow $v_2$ and causes the cable drum 46 to reverse its rotation in the direction of the arrow $r_2$. This movement is continued, until the end feeler 9 has reached the signal element 42, which has then been brought into a switching position in such a way, that the end feeler 9 "recognizes" an edge and here also now causes the formation of a reversing signal. The last-mentioned signal is again transformed by the control means 50, 52 into a command signal, which causes the cleaning device 1 and the cable drum 46 to reverse its direction of movement, and so on.

As soon as the cleaning process has terminated in the gun barrel 12, the signal element 42 is again brought into its neutral position, so that no reversing signal is formed, when the end feeler 9 (and also somewhat later the end feeler 8) slides over the corresponding region as the cleaning device 1 passes thereover in the direction of the arrow $v_2$. By switching the signal element 42 into its neutral position the signal element 43 is activated, which causes the following: as soon as the end feeler 9 reaches the signal element 43 a signal is formed, which is processed in the control means 50, 52 into a control signal "off," which causes a cessation of operation of the cleaning device 1 as well as of the motor 48. There can be provided non-illustrated conventional means, to produce an optical and/or acoustic signal which indicates a termination of the cleaning process. When the cleaning process is terminated the cleaning device 1 is again situated in a position such as the one illustrated in FIG. 1. The entire arrangement can then be detached from the gun barrel 12 and removed. Depending on the situation, the detachment can be carried out according to the following procedure: While the end 41 of the pipe assembly 32 is still supported by the telescopic pipe 64, 65 and remains at the same level as the gun barrel 12, there can, after detachment of the connecting and tensioning means 22, be opened the upper cup 26,28 of the centering and tensioning mechanism 22 relative to the lower cup 24 and can be pivoted relative thereto and the entire arrangement can then be lowered relative to the gun barrel 12. While this is done, the cleaning device 1 due to the frictional engagement with the inner surface 21 of the carriage 22 and also the frictional engagement with the inner surface 31 of the semi-cylindrical cover member 30, remains firmly seated in the pipe assembly 32. It can be noted from the foregoing description that the pipe assembly 32 can also serve and be advantageously used as a storing and transporting container for the cleaning device 1. For space-saving storing and transporting of the arrangement together with the cleaning device 1, the telescopic support pipe 64, 65 can be pivoted about the pivot support 63 so that its free end is detachably clampingly held in a clamping arrangement 66 extending from the lower cup 24. The supporting elements 64, 65 which are illustrated as a telescopic pole, can advantageously, be formed as a pair of legs having a telescopic portion, so that when lifting the arrangement to the level of the muzzle 15 of the gun barrel 12, there is provided a firm support for the opposite end of the composite pipe assembly 32.

Since the introducing arrangement in accordance with the invention is only required to be used at the beginning and end of the corresponding cleaning process, the program control means 50 and 52 can also be mounted at different sites than those illustrated. In this way the cleaning device 1 can also be operated in those situations in which the introducing arrangement should not remain mounted on the gun barrel 12 during the entire cleaning process.

The removal of the cleaning device from the gun barrel 12 corresponds essentially to the afore-described operation of introducing the cleaning device into the gun barrel, in particular in view of the fact that the same path has to be traversed in both process steps except that the cleaning device now moves in an opposite direction. Accordingly, the invention also includes the steps of removing the cleaning device from the gun barrel and composite pipe assembly 32.

The process and arrangement of the invention can also be used to clean cylindrical surfaces other than gun barrels, such as, for example, pipe lines which can be disassembled.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

I claim:

1. A process for introducing an automatic cleaning device into a gun barrel, wherein said cleaning device is adapted to reciprocably move along the longitudinal axis of the gun barrel between two end regions thereof, said cleaning device having a driving motor, driving rollers and a pair of rotating brush means adapted to rotate in mutually opposite directions for advancing and centering the cleaning device in the gun barrel by having the radially outer periphery of the brush means engage the interior gun barrel surface, said cleaning device being provided with sensing means to sense when the cleaning device reaches one of said two end regions, and being further provided with electrical conduit supply means disposed outside of the gun barrel adapted to supply energy to said driving motor via an electric cable, said pair of rotating brush means when rotating in mutually opposite directions do essentially not produce any turning moment about the longitudinal axis of the gun barrel due to frictional engagement with the internal walls thereof during the cleaning operation therein, comprising the steps of (a) coaxially detachably fastening a trough-like longitudinal member to the gun barrel, said trough-like member being at least as long as said cleaning device, (b) positioning the cleaning device on the trough-like longitudinal member;

(c) mounting for a predetermined period of time an additional mating member on said trough-like member which forms therewith a composite pipe member which is coaxial with and of the same caliber as said gun barrel; and (d) moving said cleaning device into said gun barrel by means of said driving rollers by energizing the driving motor of said cleaning device via said electric conduit supply means.

2. An arrangement for introducing an automatic cleaning device into a gun barrel, comprising in combination, a trough-like member adapted to be detachably secured to the muzzle of said gun barrel;

centering and tensioning means operatively connected to said muzzle and said gun barrel for detachably securing the trough-like member in coaxial relationship on said muzzle;

at least one additional longitudinal member adapted to be mounted on said trough-like member to form a composite pipe member therewith, said composite pipe member having the same caliber as said gun barrel;

and means for detachably connecting said additional longitudinal member to said trough-like member; and said cleaning device is provided with sensing means, a driving motor, control means, driving rollers and a pair of rotating brush means adapted to rotate in mutually opposite directions for advancing and centering the cleaning device by engaging the inner wall surface of the gun barrel as it travels through said composite pipe member and the gun barrel.

3. The arrangement for introducing an automatic cleaning device into a gun barrel as set forth in claim 2, wherein said trough-like member and said additional mating member define a separating gap therebetween which extends parallel to the longitudinal axis of said composite pipe, and wherein said centering and tensioning means comprise a first lower cup member which is joined to said trough-like member and which is adapted to be mounted on the underside of the muzzle of the gun barrel, an upper cup member adapted to be mounted on the upper side of the muzzle of the gun barrel, said lower and upper cup members having respectively contacting surfaces which are adapted to matingly contact the outer surface of the muzzle of the gun barrel, and means connecting said upper and lower cup members to each other and causing them to tightly fit on the muzzle of the gun.

4. The arrangement for introducing an automatic cleaning device into a gun barrel as set forth in claim 3, wherein said separating gap is disposed in a horizontal plane passing through the longitudinal axis of said composite pipe.

5. The arrangement for introducing an automatic cleaning device into a gun barrel as set forth in claim 4, wherein an actuating element is mounted in said trough-like member in a region adjoining the muzzle of the gun barrel, said actuating element being adapted to emit a signal when contacted by one of said sensing means.

6. The arrangement for introducing an automatic cleaning device into a gun barrel as set forth in claim 5, including a bracket extending from the end of said trough-like member which is distant from the muzzle of the gun barrel, a cable drum reversably rotatably mounted on said bracket, a cable conduit wound on said cable drum and being operatively connected at one of its ends to said drive motor, and control means, main electrical energy supply means, and a second drive motor all operatively mounted on said bracket.

7. The arrangement for introducing an automatic cleaning device into a gun barrel as set forth in claim 6, wherein the cleaning device is operatively connected to said control means via said cable conduit.

* * * * *